US011477571B2

(12) United States Patent
Ryan et al.

(10) Patent No.: US 11,477,571 B2
(45) Date of Patent: Oct. 18, 2022

(54) ELECTRICAL DEVICE FOR REDUCING NOISE

(71) Applicant: Dark Reign Industries Pty Ltd, Doonside (AU)

(72) Inventors: Andrew John Ryan, Doonside (AU); Frederick Nicolaas Ham, Doonside (AU)

(73) Assignee: DARK REIGN INDUSTRIES PTY LTD, Doonside (AU)

( * ) Notice: Subject to any disclaimer, the term of this patent is extended or adjusted under 35 U.S.C. 154(b) by 0 days.

(21) Appl. No.: 17/677,460

(22) Filed: Feb. 22, 2022

(65) Prior Publication Data

US 2022/0182758 A1 Jun. 9, 2022

Related U.S. Application Data

(63) Continuation of application No. PCT/AU2019/051166, filed on Oct. 24, 2019.

(51) Int. Cl.
*H04R 3/00* (2006.01)
*H04R 19/01* (2006.01)

(52) U.S. Cl.
CPC ..... *H04R 3/005* (2013.01); *H04R 19/016* (2013.01); *H04R 2410/01* (2013.01)

(58) Field of Classification Search
CPC ..... G10L 21/0208; G10L 2021/02165; H04R 3/005
USPC ..... 381/94.7, 113, 94.1
See application file for complete search history.

(56) References Cited

U.S. PATENT DOCUMENTS 5,218,642 A * 6/1993 Chin-Fa ..... H04R 3/02 381/83
5,243,660 A * 9/1993 Zagorski ..... H04R 3/005 381/27
5,448,637 A 9/1995 Yamaguchi et al.
5,825,897 A * 10/1998 Andrea ..... G10K 11/17823 381/71.7
6,614,911 B1 * 9/2003 Watson ..... H04B 1/3805 381/357
7,072,476 B2 * 7/2006 White ..... H04R 5/033 381/328
2009/0097674 A1 4/2009 Watson et al.
(Continued)

OTHER PUBLICATIONS

International Search Report corresponding to International Patent Application No. PCT/AU2019/051166, dated Dec. 10, 2019.
(Continued)

*Primary Examiner* — Alexander Krzystan
(74) *Attorney, Agent, or Firm* — Myers Wolin, LLC

(57) ABSTRACT

An electrical device for reducing noise, comprises a first microphone configured to receive soundwave from a sound source and convert the soundwave to a first electrical signal including a noise component, a second microphone configured to receive ambient noise from an ambient environment and convert the ambient noise to a second electrical signal. The second electrical signal is reversed in polarity to the first electrical signal. The electrical device further comprises a circuit connecting the first microphone and the second microphone. The circuit is configured to combine the first electrical signal and the second electrical signal in order to reduce the noise component in the first electrical signal with the second electrical signal that is reversed in polarity.

11 Claims, 6 Drawing Sheets

(56) References Cited

U.S. PATENT DOCUMENTS

2013/0034239 A1* 2/2013 Shin ..... H04R 1/1083
381/74
2014/0241530 A1* 8/2014 Kanatus ..... H04R 3/005
381/26

OTHER PUBLICATIONS

International Preliminary Report on Patentability issued for corresponding to International Patent Application No. PCT/AU2019/051166, dated Jun. 26, 2020.

* cited by examiner

ELECTRICAL DEVICE FOR REDUCING NOISE

CROSS REFERENCE TO RELATED APPLICATIONS

This application is a continuation of International Application PCT/AU2019/051166, filed Oct. 24, 2019, the contents of each of which are incorporated by reference herein.

TECHNICAL FIELD

The present invention generally relates to noise cancelling and reducing technologies and more particularly to an electrical device for reducing noise.

BACKGROUND

Noise control or noise cancelling has long been used as a means of reducing undesired sound, often for personal comfort, environmental considerations or legal compliance. It is being implemented in a number of electronic and communication devices such as cellular phones, two-way radios/walkie talkies, microphones, headsets, speakers etc. The main purpose of this technology is to eliminate or reduce the undesired (such as ambient) noise so that only the desired sound is heard, for example, the voice of a person.

During communication or sound recordings, ambient noise in the surroundings creates disturbance in communication or recording and does not allow effective transmission of sound. For example, during communication between users via walkie talkies, the ambient noise might be louder than the voice of the users or loud enough to disturb the communication. As a result, the users are unable to hear each other clearly.

Therefore, there is a need in the art to develop an electrical device for reducing noise and does not suffer above the above deficiencies or at least provide a viable and effective alternative.

SUMMARY

The present invention is described hereinafter by various embodiments. This invention may, however, be embodied in many different forms and should not be construed as limited to the embodiment set forth herein.

There is provided an electrical device for reducing noise. The electrical device comprises a first microphone configured to receive soundwave from a sound source and convert the soundwave to a first electrical signal including a noise component, wherein the first microphone includes a first positive terminal and a first negative terminal, the first electrical signal is output from the first positive terminal of the first microphone; a second microphone configured to receive ambient noise from ambient environment and convert the ambient noise to a second electrical signal, wherein the second microphone is an electret microphone including a second positive terminal and a second negative terminal, the second electrical signal is output from the second negative terminal of the second microphone to be reversed in polarity to the first electrical signal; and a circuit connecting the first microphone and the second microphone wherein the circuit comprises a second resistor connected to the second negative terminal of the second microphone and the second positive terminal of the second microphone is connected to ground of the circuit, the second resistor being configured to generate a second bias voltage for the second negative terminal of the second microphone and reduce current passing through the second microphone in order to reverse the second electrical signal in polarity, and the circuit is further configured to combine the first electrical signal and the second electrical signal in order to reduce the noise component in the first electrical signal with the second electrical signal that is reversed in polarity.

It is advantageous that the second electrical signal representing the ambient noise is reversed in polarity and combined with the first electrical signal. This way, the noise component in the first electrical signal is dramatically reduced and the combined signal has a higher signal-to-noise ratio. As a result, the sound generated based on the combined signal at a receiving device is clearer to the user using the receiving device.

The first microphone is a unidirectional electret microphone, the first negative terminal being connected to the ground of the circuit.

The second microphone is an omnidirectional electret microphone.

The circuit further comprises a first capacitor connected between the first positive terminal of the first microphone and the ground of the circuit in order to filter out high frequency current in the first electrical signal.

The circuit further comprises a first resistor connected to the first positive terminal of the first microphone in order to generate a first bias voltage for the first positive terminal of the first microphone.

The circuit further comprises a first inductor in series connection with the first resistor in order to prevent high frequency interference.

The circuit further comprises a second capacitor connected between the second negative terminal of the second microphone and the ground of the circuit in order to filter out high frequency current in the second electrical signal.

The circuit further comprises a second inductor in series connection with the second resistor in order to prevent high frequency interference.

The circuit further comprises an output terminal to connect the first inductor and the second inductor in order to combine the first electrical signal and the second electrical signal at the output terminal.

The circuit further comprises a third resistor connected to the first negative terminal of the first microphone and the second positive terminal of the second microphone in order to prevent electromechanical feedback.

In accordance with an embodiment of the present invention, the circuit further comprises a switch in series connection with the third resistor.

BRIEF DESCRIPTION OF THE DRAWINGS

At least one example of the present invention will be described with reference to the accompanying drawings, in which.

It should be noted in the accompanying drawings and description below that like or the same reference numerals in different drawings denote the same or similar elements.

DETAILED DESCRIPTION

Figure 1:
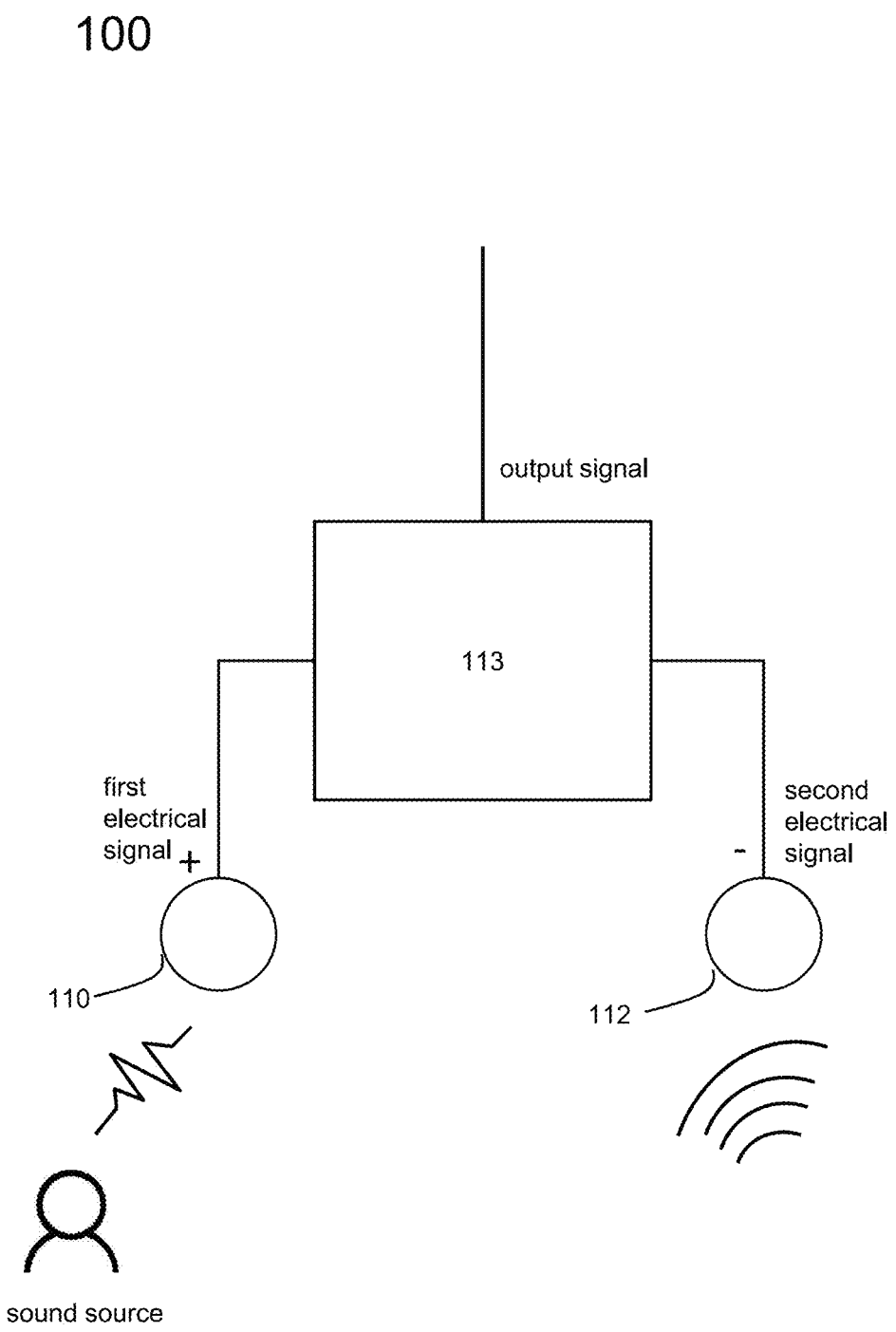
FIG. 1 illustrates a structural diagram of an electrical device for reducing noise in accordance with an embodiment of the present invention.

FIG. 1 illustrates a structural diagram of an electrical device 100 for reducing noise, in accordance with an embodiment of the present invention. As shown in FIG. 1, the electrical device 100 comprises a first microphone 110, a second microphone 112 and a circuit 113. The first microphone 110 is placed near or towards a sound source when in use and is particularly configured to receive soundwave from the sound source. The sound source can be any object that generates a desired soundwave, which is intended to be received by the first microphone 110. In the example shown in FIG. 1, the sound source is a person that is speaking towards the first microphone 110. The soundwave from the sound source, i.e., the voice of the person in this example, is propagated to the first microphone 110 via transmission media, particularly, air, and captured by the first microphone 110. The first microphone 110 then converts the soundwave to a first electrical signal. In practice, during transmission of the soundwave in the transmission media, the soundwave of the sound source is interfered by at least part of ambient noise, which might be caused by other objects, for example, machines or vehicles operating nearby, other people speaking nearby or even echo of the desired soundwave. As a result, the first electrical signal converted by the first microphone 110 includes a noise component in addition to the voice of the person. In the example shown in FIG. 1, the first electrical signal is output from the positive terminal of the first microphone 110.

As shown in FIG. 1, the second microphone 112 is placed away from the sound source when in use and particularly configured to receive ambient noise from the surrounding environment and convert the ambient noise to a second electrical signal representing the ambient noise. The ambient noise includes any undesired sounds generated in the surrounding environment, for example, traffic, honking cars, yelling, loud music or any other undesirable noise. In the example shown in FIG. 1, the second electrical signal is output from the negative terminal of the second microphone 112 and is reversed in polarity to the first electrical signal.

The circuit 113 connects the first microphone 110 and the second microphone 112 and is configured to combine the first electrical signal and the second electrical signal. For example, the circuit 113 can be an adder circuit to add the first electrical signal and the second electrical signal. As a result, the resulting output signal of the circuit 113 is the sum of the first electrical signal and the second electrical signal. As the second electrical signal is reversed in polarity to the first electrical signal, the noise component in the first electrical signal is reduced by the second electrical signal after the first electrical signal and the second electrical signal are added. Therefore, the resulting output signal of the electrical device 100 has a higher signal-noise ratio (SNR) compared to the first electrical signal including voice and noise. The output signal of the electrical device 100 can be further processed, for example, digitalised (analog-digital conversion), modulated and transmitted to a receiving device. The receiving device generates a sound signal with a higher SNR from the received signal via for example demodulation and digital-analog conversion. When the sound signal is played from the speaker of the receiving device, the user using the receiving device is able to hear the voice of the person more clearly as the sound signal has a higher SNR.

Figure 2:
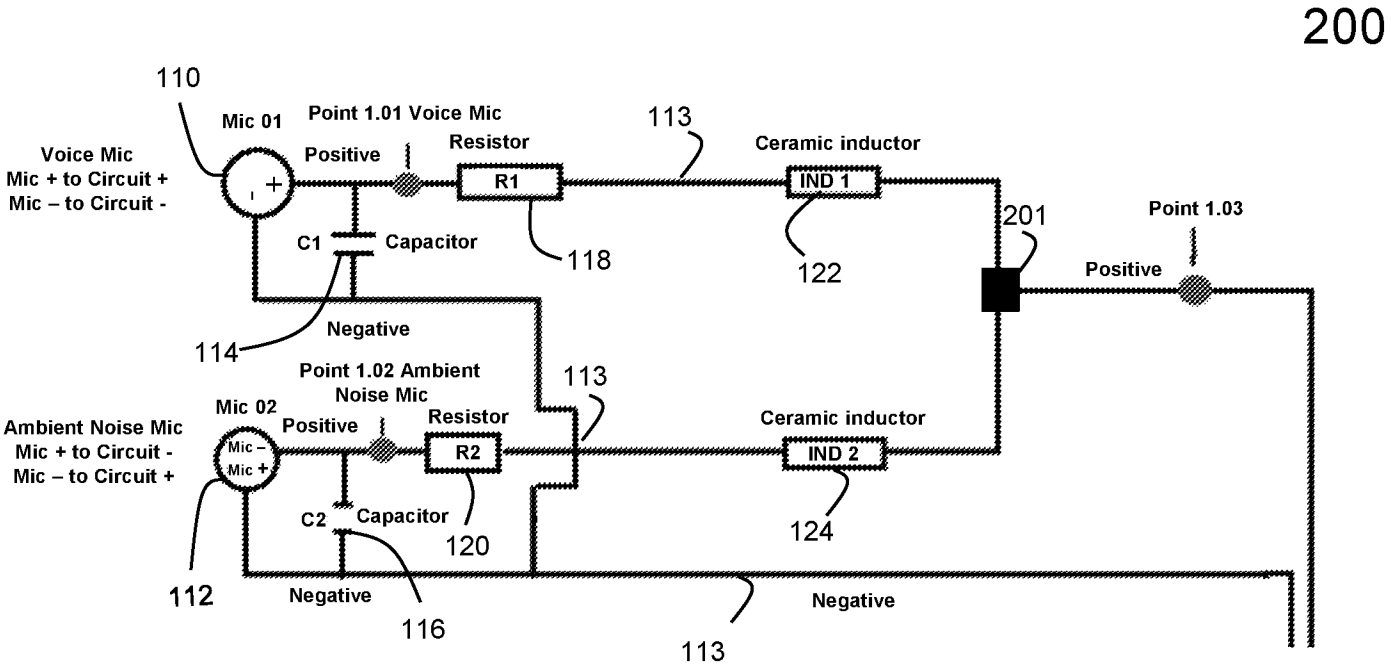
FIG. 2 illustrates an electrical device for reducing noise in accordance with an embodiment of the present invention.

FIG. 2 illustrates an electrical device 200 for reducing noise in accordance with an embodiment of the present invention. The circuit 113 in electrical device 200 has a ground or negative to establish a connection between the first microphone 110 and the second microphone 112. The first microphone 110 (i.e., "voice mic" in FIG. 2) in the electrical device 200 is a unidirectional electret microphone including a first positive terminal and a first negative terminal. The first negative terminal is connected to the ground or negative of the circuit 113 and the first electrical signal, which can be measured at point 1.01 in FIG. 2, is output at the first positive terminal of the first microphone 110. The unidirectional microphone is able to capture the soundwave from a particular direction while suppressing sound from other directions. In an example, when the first microphone 110 receives sound signals at the 0 degree angle, minimal ambient signal is detected, which only allows signal to be received from one direction and its lower bandwidth filters out unwanted higher frequencies. This way, when the first microphone 110 is oriented towards the sound source, the soundwave received at the unidirectional microphone 110 is less interfered by ambient noise, and the resulting first electrical signal in turn includes less noise. This eventually leads to a better output signal of the electrical device 200, which can be measured at point 1.03 in FIG. 2.

Further, the second microphone 112 in the electrical device 200 is an electret omnidirectional microphone including a second positive terminal and a second negative terminal. As shown in FIG. 2, the second positive terminal is connected to the ground of the circuit 113 and the second electrical signal, which can be measured at point 1.02 in FIG. 2, is output at the second negative terminal of the second microphone 112. The electret omnidirectional microphone receives sounds from all directions with substantially equal gain. This way, the resulting second electrical signal is able to accurately represent the ambient noise. Additionally, the second electrical signal is output at the second negative terminal of the second microphone 112 and the second electrical signal is reversed in polarity to the first electrical signal which is output at the first positive terminal of the first microphone 110.

As shown in FIG. 2, the circuit 113 comprises a first capacitor 114. The first capacitor 114 is connected between the first positive terminal of the first microphone 110 and the ground of the circuit 113. The first capacitor 114 is configured to filter out high frequency current in the first electrical signal to stop sporadic radio frequency from entering the low frequency audio circuit 113 and prevent voltage spikes when the circuit 113 is closed. The first capacitor 114 can be a ceramic capacitor and the capacitance of the first capacitor 114 can be for example 1 μF (microfarad). The circuit 113 further comprises a first resistor 118 connected to the first positive terminal of the first microphone 110. The first resistor 118 is to generate a first bias voltage for the first positive terminal of the first microphone 110, and the first resistor 118 is able to add slight attenuation to the first electrical signal. The resistance of the first resistor 118 can be for example 1.8 kΩ (kiloohm). The circuit 113 further comprises a first inductor 122 that is in series connection with the first resistor 118. When the electrical device 200 is integrated into a radio device (for example, a mobile phone)

as part of the radio device, not shown in FIG. 2, which normally includes a radio frequency transmission device used to transmit radio frequency signal in the air, the first inductor 122 prevents high frequency interference by stopping possible radio frequency interference created by the transmitting device from entering the low frequency audio circuit 113. The inductance of the first inductor 122 can be for example 0.02 mh (millihenry).

The circuit 113 comprises the second capacitor 116 connected between the second negative terminal of the second microphone 112 and the ground of the circuit 113. The second capacitor 116 is configured to filter out high frequency current in the second electrical signal to stop sporadic radio frequency from entering the low frequency audio circuit 113 and prevent voltage spikes when the circuit 113 is closed. The second capacitor 116 can be a ceramic capacitor and the capacitance of the second capacitor 116 can be for example 1 μF (microfarad). The circuit 113 further comprises a second resistor 120 connected to the second negative terminal of the second microphone 112. The second resistor 120 is to generate a second bias voltage for the second negative terminal of the second microphone 112. Therefore, the second resistor 120 allows the second microphone 112, (particularly, the JFET transistor in the second microphone 112 if the second microphone 112 is an electret microphone to operate in reverse polarity. The second resistor 120 also reduces the current passing through the second microphone 112 and the amplitude of the voltage across the second microphone 112. The resistance of the second resistor 120 can be for example 1.8 kΩ (kiloohm). The circuit 113 further comprises a second inductor 124 in series connection with the second resistor 120. The second inductor 124 is configured to prevent radio frequency interference created by the transmitting radio device from entering into the low frequency audio circuit 113. The inductance of the second inductor 124 can be for example 0.02 mh (millihenry).

The circuit 113 further includes an output terminal 201 to connect the first inductor 122 and the second inductor 124. This way, the circuit 113 combines the first electrical signal and the second electrical signal at the output terminal 201. The combined output signal, which is the sum of the first electrical signal and the second electrical signal, can be measured at point 1.03. As described above, the second electrical signal is reversed in polarity to the first electrical signal including the noise component. Therefore, in the combined output signal, the noise component is reduced.

The electrical device 200 shown in FIG. 2 can be integrated into a radio device (for example, a mobile phone) as part of the radio device when the radio device is manufactured by the original manufacturer. For example, the combined output signal at the output terminal 201 can be fed to other circuits of the radio device for further processing (e.g., analog-digital conversation, modulation, encryption, transmission, etc.). The ground of the circuit 113 is connected with the ground of other circuits of the radio device in order to electrically connect the electrical device 200 with other circuits of the radio device. This way, the electrical device 200 can be used in full duplex applications such as mobile telephones.

Figure 3:
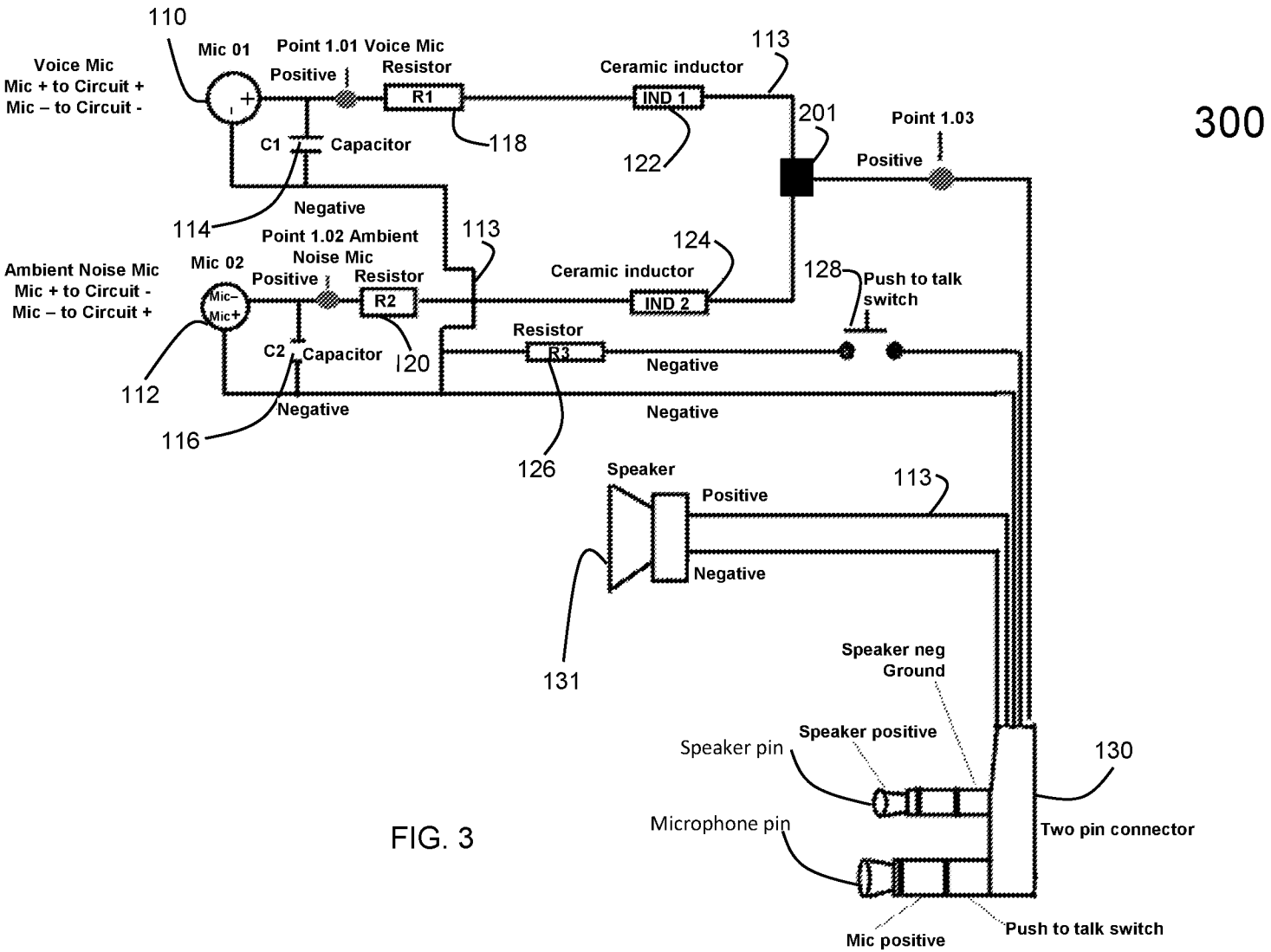
FIG. 3 illustrates an electrical device for reducing noise in accordance with an embodiment of the present invention.

FIG. 3 illustrates an electrical device 300 for reducing noise in accordance with an embodiment of the present invention. The electrical device 300 can be used as an accessory to an existing radio device without noise reduction function or if a better noise reduction function is desired.

As shown in FIG. 3, in addition to the elements shown in FIGS. 1 and 2, the circuit 113 in the electrical device 300 further includes a third resistor 126. The third resistor 126 is connected to the first negative terminal of the first microphone 110 and the second positive terminal of the second microphone 112, effectively, the ground of the circuit 113. Further, the circuit 113 includes a switch 128 in series connection with the third resistor 126 for the purpose of "push to talk". The third resistor 126 is configured to prevent electromechanical feedback from entering the low frequency audio circuit 113 when it is closed, for example, when the switch 128 is pushed down. The electromechanical feedback may be generated when the electrical device 300 is used in a half-duplex communication mode. In an example, the resistance of the third resistor 126 can be for example 0 Ω (ohm). Further, the circuit 113 includes a switch 128 in series connection with the third resistor 126 for the purpose of "push to talk". The electrical device 300 further includes a connector 130, which is configured to connect the electrical device 300, particularly, the circuit 113, as an accessory to an existing radio device (for example, a walkie talkie, not shown in FIG. 3) without the noise reduction function. For example, the connector 130 can be inserted into the radio device to connect the electrical device 300 to the radio device if the noise reduction function is desired.

The switch 128 is connected to the connector 130 for "push to talk" purposes. Further, the output terminal 201 of the electrical device 300 is connected to the connector 130 in order to feed the combined output signal, which is the sum of the first electrical signal and the second electrical signal, to the radio device for further processing, for example, analog-digital conversation, modulation, encryption, transmission. The electrical device 300 is able to provide the radio device with an input signal with a higher SNR, i.e., the combined output signal from the output terminal 201. This way, when another radio device, i.e., a receiving radio device, receives the signal from the radio device and generates sound from the signal received, the voice of the person using the radio device is clearer to the user using the receiving radio device.

The radio device, for example, a walkie talkie/two-way radio, usually includes an internal speaker to play sound generated by the radio device. The electrical device 300 may also include a speaker 131 connected to the connector 130. The connector 130 is configured to disable the internal speaker of the radio device if the connector 130 is inserted into the radio device and play the sound generated by the radio device via the speaker 131 as an external speaker.

The connector 130 in the example shown in FIG. 3 is a two pin connector. One pin is configured to connect to the speaker 131, labelled as speaker pin, while the other one is configured to control microphones 110, 112, labelled as microphone pin. The speaker pin of the connector 130 includes a positive terminal and a negative terminal/ground, while the microphone pin of the connector 130 includes a microphone terminal and a "push to talk" terminal. The speaker 131 includes a positive terminal and a negative terminal. The positive terminal of the speaker 131 is connected to the positive terminal of the speaker pin, and the negative terminal of the speaker 131 is connected to the negative terminal/ground of the speaker pin. The ground of the circuit 113 is connected to the negative terminal/ground of the speaker pin.

The microphone terminal of the microphone pin is connected to the output terminal 201 to receive the combined output signal with higher SNR. The "push to talk" terminal of the microphone pin is connected to the "push-to-talk" switch 128 for "push to talk" purposes. This way, after the connector 130 is inserted into the radio device (not shown), if the "push to talk" switch 128 is pushed down by the user using the electrical device 300, the circuit 113 is closed. Therefore, the first and second microphones 110, 112 are able to operate as described above and the combined output signal with higher SNR is output at the output terminal 201, which is further fed to the connector 130 and in turn the radio device for further processing before being transmitted to a receiving radio device. On the other hand, if the "push to talk" switch 128 is released by the user, the combined output signal is not fed to the connector 130 or the radio device. As a result, the sound from the sound source will not be transmitted to the receiving radio device. This way, the electrical device 300 can be used in a half-duplex device such as a two-way radio or a walkie talkie.

The waveforms of the first electrical signal, the second electrical signal and the combined output signal are described below with reference to FIGS. 4, 5 and 6 to show the effects of the invention.

Figure 4:
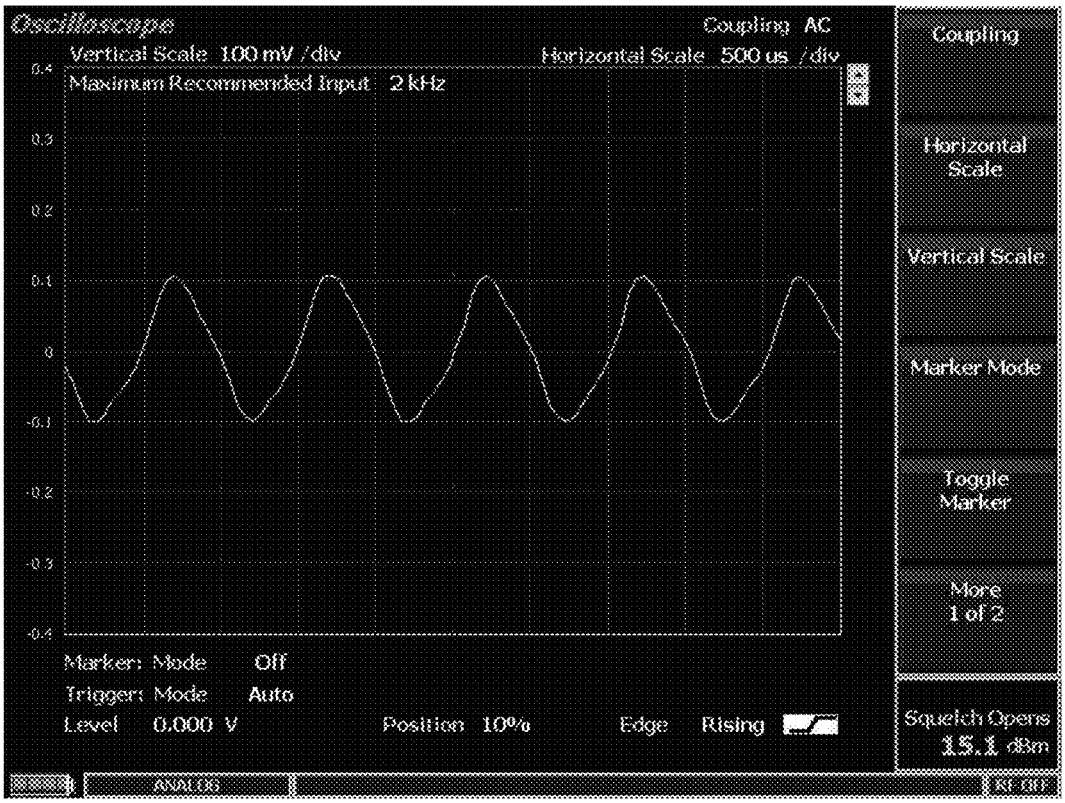
FIG. 4 illustrates a waveform of a first electrical signal measured at point 1.01 in accordance with an embodiment of the present invention.

FIG. 4 illustrates the waveform of the first electrical signal measured at point 1.01 in the electrical device 300 shown in FIG. 3. The frequency of the first electrical signal is about 1 KHz, and the peak-to-peak voltage is 200 mV, i.e., 46 DbmV. As described above, the first electrical signal includes the desired sound (for example, the voice of the person) and a noise component.

Figure 5:
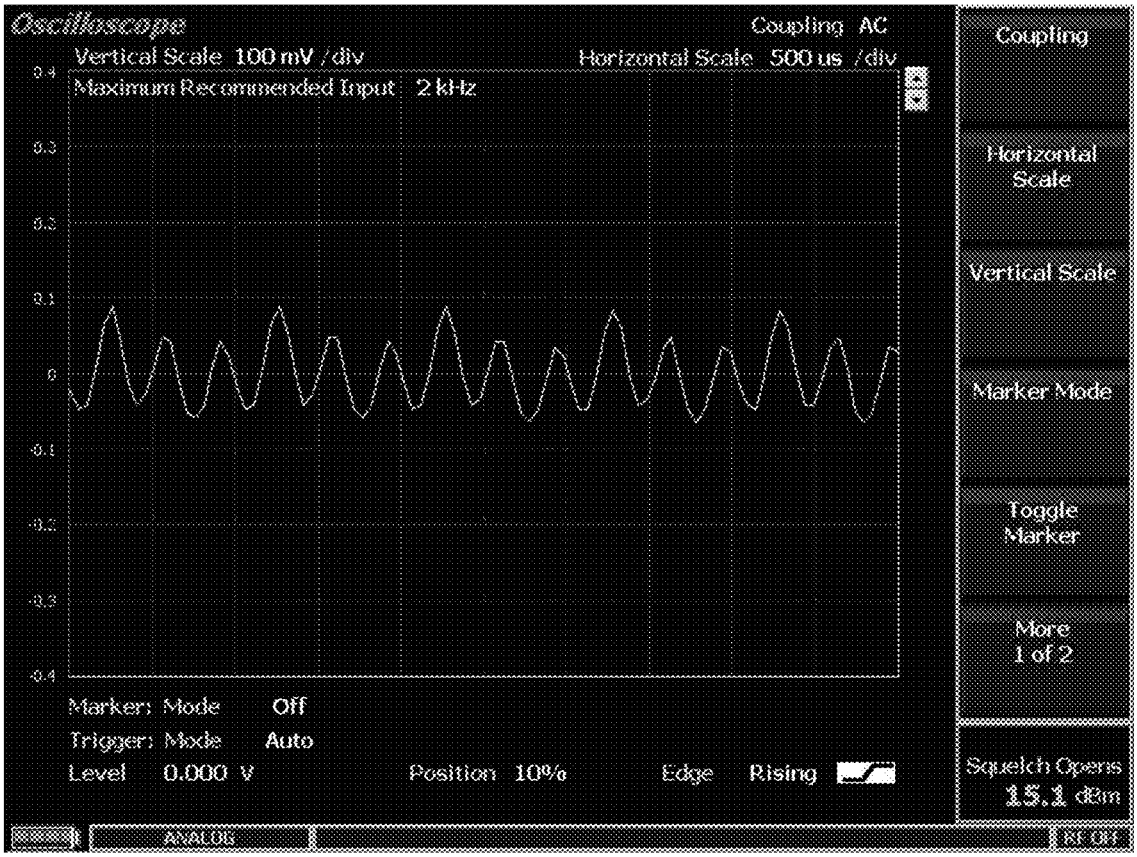
FIG. 5 illustrates a waveform of a second electrical signal measure at point 1.02 in accordance with an embodiment of the present invention.

FIG. 5 illustrates the waveform of the second electrical signal measured at point 1.02 in the electrical device 300 shown in FIG. 3. As the second microphone 112 operates in reversed polarity, the waveform of the second electrical signal is 180 degrees out of phase with the first electrical signal. In other words, the second electrical signal is reversed in polarity to the first electrical signal. The peak-to-peak voltage of the second electrical signal is 100 mV, i.e., 40 DbmV. As described above, the second electrical signal represents ambient noise.

Figure 6:
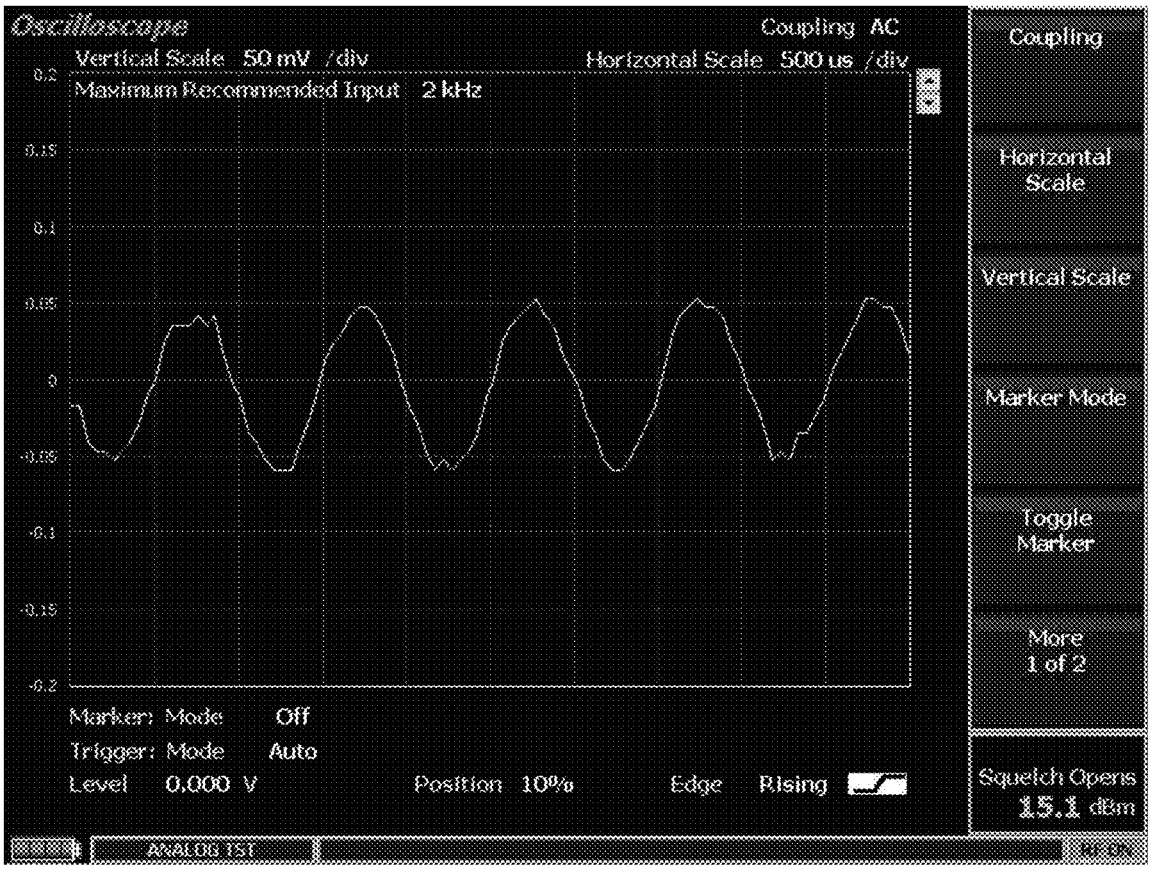
FIG. 6 illustrates a waveform of a combined output signal measured at point 1.03 in accordance with an embodiment of the present invention.

FIG. 6 illustrates the waveform of the combined output signal measured at point 1.03 in the electrical device 300 shown in FIG. 3. As described above the first electrical signal and the second electrical signal are combined, and the combined output signal is output at the output terminal 201. The combined output signal is the sum of the first electrical signal and the second electrical signal. As shown in FIG. 6, the peak-to-peak voltage of the combined output signal is 100 mV, i.e., 40 DbmV, which is less than that of the first electrical signal due to the reversed polarity of the second electrical signal.

Tests indicate that the SNR of the electrical device 300 achieves a SNR of 59 dB, while the SNR of existing radio devices (for example, walkie talkies) is claimed by their manufacturers to be about 40 dB. Therefore, the invention achieves a better audio effect than the existing radio devices.

The invention has various advantages. The invention provides a cost and energy efficient approach towards noise reduction/cancellation. The invention can provide noise reduction/cancellation over a communication device. The device can be used with various communication devices such as mobile phones, radios, walkie-talkies, satellite phones, etc.

The terms and descriptions used herein are set forth by way of illustration only and are not meant as limitations. Examples and limitations disclosed herein are intended to be not limiting in any manner, and modifications may be made without departing from the spirit of the present disclosure. Those skilled in the art will recognize that many variations are possible within the spirit and scope of the disclosure, and their equivalents, in which all terms are to be understood in their broadest possible sense unless otherwise indicated.

Various modifications to these embodiments are apparent to those skilled in the art from the description and the accompanying drawings. The principles associated with the various embodiments described herein may be applied to other embodiments. Therefore, the description is not intended to be limited to the embodiments shown along with the accompanying drawings but is meant to provide the broadest scope, consistent with the principles and the novel and inventive features disclosed or suggested herein. Accordingly, the disclosure is anticipated to hold on to all other such alternatives, modifications, and variations that fall within the scope of the present disclosure and appended claims.

The invention claimed is:

1. An electrical device for reducing noise, comprising:

a first microphone configured to receive a soundwave from a sound source and convert the soundwave to a first electrical signal including a noise component, wherein the first microphone includes a first positive terminal and a first negative terminal, the first electrical signal is output from the first positive terminal of the first microphone;

a second microphone configured to receive ambient noise from ambient environment and convert the ambient noise to a second electrical signal, wherein the second microphone is an electret microphone including a second positive terminal and a second negative terminal, the second electrical signal is output from the second negative terminal of the second microphone to be reversed in polarity to the first electrical signal;

a circuit connecting the first microphone and the second microphone, wherein the circuit comprises a second resistor connected to the second negative terminal of the second microphone and the second positive terminal of the second microphone is connected to ground of the circuit, the second resistor being configured to generate a second bias voltage for the second negative terminal of the second microphone and reduce current passing through the second microphone in order to reverse the second electrical signal in polarity, and the circuit is further configured to combine the first electrical signal and the second electrical signal in order to reduce the noise component in the first electrical signal with the second electrical signal that is reversed in polarity.

2. The electrical device of claim 1, wherein the first microphone is a unidirectional electret microphone, the first negative terminal being connected to the ground of the circuit.

3. The electrical device of claim 2, wherein the second microphone is an omnidirectional electret microphone.

4. The electrical device of claim 3, wherein the circuit further comprises a first capacitor connected between the first positive terminal of the first microphone and the ground of the circuit in order to filter out high frequency current in the first electrical signal.

5. The electrical device of claim 4, wherein the circuit further comprises a first resistor connected to the first positive terminal of the first microphone in order to generate a first bias voltage for the first positive terminal of the first microphone.

6. The electrical device of claim 5, wherein the circuit further comprises a first inductor in series connection with the first resistor in order to prevent high frequency interference.

7. The electrical device of claim 6, wherein the circuit further comprises a second capacitor connected between the second negative terminal of the second microphone and the ground of the circuit in order to filter out high frequency current in the second electrical signal.

8. The electrical device of claim 7, wherein the circuit further comprises a second inductor in series connection with the second resistor in order to prevent high frequency interference.

9. The electrical device of claim 8, wherein the circuit further comprises an output terminal to connect the first inductor and the second inductor in order to combine the first electrical signal and the second electrical signal at the output terminal.

10. The electrical device of claim 9, wherein the circuit further comprises a third resistor connected to the first negative terminal of the first microphone and the second positive terminal of the second microphone in order to prevent electromechanical feedback.

11. The electrical device of claim 10, wherein the circuit further comprises a switch in series connection with the third resistor.

* * * * *